US006997789B2

(12) United States Patent
Moore

(10) Patent No.: US 6,997,789 B2
(45) Date of Patent: Feb. 14, 2006

(54) METHOD AND APPARATUS FOR PLANARIZING A MICROELECTRONIC SUBSTRATE WITH A TILTED PLANARIZING SURFACE

(75) Inventor: Scott E. Moore, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 387 days.

(21) Appl. No.: 09/929,137

(22) Filed: Aug. 13, 2001

(65) Prior Publication Data

US 2002/0028638 A1 Mar. 7, 2002

Related U.S. Application Data

(63) Continuation of application No. 09/388,828, filed on Sep. 1, 1999, now Pat. No. 6,273,796.

(51) Int. Cl.
*B24B 1/00* (2006.01)

(52) U.S. Cl. ..... 451/168; 451/173; 451/451

(58) Field of Classification Search ..... 451/41, 451/5, 7, 8, 285–289, 443, 444, 163, 168, 451/173, 451
See application file for complete search history.

(56) References Cited

U.S. PATENT DOCUMENTS

| | | | | |
|---|---|---|---|---|
| 3,237,230 A | | 3/1966 | Forrest | |
| 4,780,010 A | | 10/1988 | Behrens et al. | 400/208 |
| 5,501,536 A | | 3/1996 | Kleve | 400/208 |
| 5,547,298 A | | 8/1996 | Wouters et al. | 400/692 |
| 5,695,292 A | | 12/1997 | Coote | 400/250 |
| 5,718,618 A | * | 2/1998 | Guckel et al. | 451/41 |
| 5,727,989 A | | 3/1998 | Ohno et al. | 451/41 |
| 5,782,675 A | * | 7/1998 | Southwick | 451/56 |
| 5,810,964 A | | 9/1998 | Shiraishi | 156/345 |
| 5,823,854 A | * | 10/1998 | Chen | 451/9 |
| 5,865,545 A | | 2/1999 | Kondo | 400/207 |
| 5,912,184 A | * | 6/1999 | Young | 438/692 |
| 5,915,860 A | | 6/1999 | Laurent | 400/242 |
| 5,957,594 A | | 9/1999 | Loidl | 400/237 |
| 5,957,750 A | | 9/1999 | Brunelli | 451/7 |
| 5,984,546 A | | 11/1999 | Kameyama | 400/208 |
| 5,997,385 A | | 12/1999 | Nishio | 451/56 |
| D418,860 S | | 1/2000 | Shimoyama et al. | D18/12 |
| 6,039,635 A | | 3/2000 | Mitsuhashi et al. | 451/72 |
| D425,545 S | | 5/2000 | Ishida | D18/12 |
| 6,068,542 A | | 5/2000 | Hosakai | 451/37 |
| 6,129,612 A | * | 10/2000 | Reynen et al. | 451/53 |
| 6,135,859 A | | 10/2000 | Tietz | 451/41 |
| 6,139,402 A | | 10/2000 | Moore | 451/41 |
| 6,155,913 A | | 12/2000 | Quek | 451/57 |
| 6,179,689 B1 | | 1/2001 | Ohno et al. | 451/41 |
| 6,193,588 B1 | | 2/2001 | Carlson et al. | 451/66 |
| 6,195,111 B1 | | 2/2001 | Nelson et al. | 347/214 |

(Continued)

*Primary Examiner*—M. Rachuba
(74) *Attorney, Agent, or Firm*—Dorsey & Whitney LLP

(57) ABSTRACT

A method and apparatus for planarizing a microelectronic substrate. In one embodiment, the apparatus can include an elongated, non-continuous polishing pad oriented at an angle relative to the horizontal to allow planarizing liquids and materials removed from the microelectronic substrate to flow off the polishing pad under the force of gravity. Two such polishing pads can be positioned opposite each other in a vertical orientation and can share either a common platen or a common substrate carrier. The polishing pads can be pre-attached to both a supply roll and a take-up roll to form a cartridge which can be easily removed from the apparatus and replaced with another cartridge.

16 Claims, 7 Drawing Sheets

U.S. PATENT DOCUMENTS 6,273,800 B1 8/2001 Walker et al. ..... 451/168
6,296,557 B1 * 10/2001 Walker ..... 451/526
6,296,717 B1 10/2001 Ticknor et al. ..... 134/10
6,312,319 B1 * 11/2001 Donohue et al. ..... 451/56
6,315,857 B1 * 11/2001 Cheng et al. ..... 156/345.12
6,315,875 B1 11/2001 Sasaki ..... 204/192.34
6,361,417 B1 3/2002 Walker et al. ..... 451/168
6,368,197 B1 4/2002 Elledge ..... 451/296
6,407,000 B1 * 6/2002 Hudson ..... 438/693
6,413,873 B1 7/2002 Li et al. ..... 438/711
6,428,404 B1 * 8/2002 Walker et al. ..... 451/311
6,491,570 B1 12/2002 Sommer et al. ..... 451/41
6,537,136 B1 * 3/2003 Carlson ..... 451/41
6,558,234 B1 5/2003 Walker et al. ..... 451/41

* cited by examiner

METHOD AND APPARATUS FOR PLANARIZING A MICROELECTRONIC SUBSTRATE WITH A TILTED PLANARIZING SURFACE

CROSS-REFERENCE TO RELATED APPLICATION

This application is a continuation of U.S. patent application Ser. No. 09/388,828, filed Sep. 1, 1999 now U.S. Pat. No. 6,273,796.

TECHNICAL FIELD

The present invention relates to methods and apparatuses for planarizing microelectronic substrates and, more particularly, to polishing pads having non-horizontal planarizing surfaces.

BACKGROUND OF THE INVENTION

Mechanical and chemical-mechanical planarizing processes (collectively "CMP") are used in the manufacturing of microelectronic devices for forming a flat surface on semiconductor wafers, field emission displays and many other microelectronic-device substrates and substrate assemblies. FIG. 1 schematically illustrates a conventional CMP machine 10 having a platen 20. The platen 20 supports a planarizing medium 40 that can include a polishing pad 41 having a planarizing surface 42 on which a planarizing liquid 43 is disposed. The polishing pad 41 may be a conventional polishing pad made from a continuous phase matrix material (e.g., polyurethane), or it may be a fixed-abrasive polishing pad made from abrasive particles fixedly dispersed in a suspension medium. The planarizing liquid 43 may be a conventional CMP slurry with abrasive particles and chemicals that remove material from the wafer, or the planarizing liquid may be a planarizing solution without abrasive particles. In most CMP applications, conventional CMP slurries are used on conventional polishing pads, and planarizing solutions without abrasive particles are used on fixed abrasive polishing pads.

The CMP machine 10 can also include an underpad 25 attached to an upper surface 22 of the platen 20 and the lower surface of the polishing pad 41. A drive assembly 26 rotates the platen 20 (as indicated by arrow A), and/or it reciprocates the platen 20 back and forth (as indicated by arrow B). Because the polishing pad 41 is attached to the underpad 25, the polishing pad 41 moves with the platen 20.

A wafer carrier 30 is positioned adjacent the polishing pad 41 and has a lower surface 32 to which a substrate 12 may be attached via suction. Alternatively, the substrate 12 may be attached to a resilient pad 34 positioned between the substrate 12 and the lower surface 32. The wafer carrier 30 may be a weighted, free-floating wafer carrier, or an actuator assembly 33 may be attached to the wafer carrier to impart axial and/or rotational motion (as indicated by arrows C and D, respectively).

To planarize the substrate 12 with the CMP machine 10, the wafer carrier 30 presses the substrate 12 face-downward against the polishing pad 41. While the face of the substrate 12 presses against the polishing pad 41, at least one of the platen 20 or the wafer carrier 30 moves relative to the other to move the substrate 12 across the planarizing surface 42. As the face of the substrate 12 moves across the planarizing surface 42, material is continuously removed from the face of the substrate 12.

FIG. 2 is a partially schematic isometric view of a conventional web-format planarizing machine 10*a* that has a table 11 with a support surface 13. The support surface 13 is a generally rigid panel or plate attached to the table 11 to provide a flat, solid workstation for supporting a portion of a web-format planarizing pad 40*a* in a planarizing zone "E" during planarization. The planarizing machine 10*a* also has a pad advancing mechanism, including a plurality of rollers, to guide, position, and hold the web-format pad 40*a* over the support surface 13. The pad advancing mechanism generally includes a supply roller 24, first and second idler rollers 21*a* and 21*b*, first and second guide rollers 22*a* and 22*b*, and a take-up roller 23. As explained below, a motor (not shown) drives the take-up roller 23 to advance the pad 40*a* across the support surface 13 along a travel path T—T. The motor can also drive the supply roller 24. The first idler roller 21*a* and the first guide roller 22*a* press an operative portion of the pad 40*a* against the support surface 13 to hold the pad 40*a* stationery during operation.

The planarizing machine 10*a* also has a carrier assembly 30*a* to translate the substrate 12 over the pad 40*a*. In one embodiment, the carrier assembly 30*a* has a head 31 to pick up, hold and release the substrate 12 at appropriate stages of the planarizing process. The carrier assembly 30*a* also has a support gantry 34 and a drive assembly 35 that can move along the gantry 34. The drive assembly 35 has an actuator 36, a drive shaft 37 coupled to the actuator 36 and an arm 38 projecting from the drive shaft 37. The arm 38 carries the head 31 via a terminal shaft 39. The actuator 36 orbits the head 31 about an axis F—F (as indicated by arrow $R_1$) and can rotate the head 31 (as indicated by arrow $R_2$) to move the substrate 12 over the polishing pad 40*a* while a planarizing fluid 43*a* flows from a plurality of nozzles 45 in the head 31. The planarizing fluid 43*a* may be a conventional CMP slurry with abrasive particles and chemicals that etch and/or oxidize the substrate 12, or the planarizing fluid 43*a* may be a non-abrasive planarizing solution without abrasive particles, as was discussed above with reference to FIG. 1.

In the operation of the planarizing machine 10*a*, the polishing pad 40*a* moves across the support surface 13 along the travel path T—T either during or between planarizing cycles to change the particular portion of the polishing pad 40*a* in the planarizing zone E. For example, the supply and take-up rollers 24 and 23 can drive the polishing pad 40*a* between planarizing cycles such that a point P moves incrementally across the support surface 13 to a number of intermediate locations $I_1$, $I_2$, etc. Alternatively, the rollers 24 and 23 may drive the polishing pad 40*a* between planarizing cycles such that the point P moves all the way across the support surface 13 to completely remove a used portion of the polishing pad 40*a* from the planarizing zone E. The rollers 23 and 24 may also continuously drive the polishing pad 40*a* at a slow rate during a planarizing cycle such that the point P moves continuously across the support surface 13 during planarization. In any case, the motion of the polishing pad 40*a* is generally relatively slow when the substrate 12 engages the polishing pad 40*a*, and the relative motion between the substrate 12 and the polishing pad 40*a* is primarily due to the motion of the head 31. In a preferred method of operation, the polishing pad 40*a* is oriented horizontally to ensure that it is perpendicular to the orbit axis F—F of the head 31, and to keep the planarizing fluid 43*a* on the polishing pad 40*a*.

CMP processes should consistently and accurately produce a uniform, planar surface on substrates to enable circuit and device patterns to be formed with photolithography techniques. As the density of integrated circuits increases, it is often necessary to accurately focus the critical dimensions of the photo-patterns to within a tolerance of approximately 0.1 microns. Focussing photo-patterns to such small tolerances, however, is difficult when the planarized surfaces of the substrates are not uniformly planar. Thus, to be effective, CMP processes should create highly uniform, planar surfaces on the substrates.

One drawback with the arrangement shown in FIG. 2 is that it can be inefficient to periodically remove and replace the polishing pad 40*a*. For example, it can be awkward and time consuming to thread the polishing pad 40*a* from a new supply roller 24, through the idler rollers 21*a* and 21*b*, through the guide rollers 22*a* and 22*b* and then attach the polishing pad 40*a* to the take-up roller 23.

Another drawback with the arrangements shown in both FIGS. 1 and 2 is that the material removed from the substrate and/or the polishing pad can remain on the polishing pad as the planarizing operation continues. The removed material can damage the substrate, for example, by becoming caught between the polishing pad and the substrate and scratching or otherwise adversely affecting the surface of the substrate.

Still another drawback with some conventional arrangements is that ventilation air is generally directed downwardly toward the polishing pad striking the polishing pad at an approximately 90° angle. As the air strikes the polishing pad, it typically becomes turbulent, which can separate dried particles or agglomerations of dried particles from the planarizing machine and allow such particles to settle on the polishing pad where they can scratch the substrate 12. The turbulent ventilation air can also be difficult to collect and exhaust from the region adjacent the polishing pad 40*a*.

One conventional approach to addressing some of the foregoing drawbacks is to position the substrate against a continuous vertical polishing pad and move the polishing pad at a high speed relative to the substrate, in the manner of a belt sander. FIG. 3 is a partially schematic, side elevation view of one such conventional CMP apparatus 10*b* having two rollers 25 and a continuous polishing pad 40*b* extending around the two rollers 25. The polishing pad 40*b* can be supported by a continuous support band 41, formed from a flexible material, such as a thin sheet of stainless steel. A pair of platens 20*b* provide additional support for the polishing pad 40*b* at two opposing planarizing stations. Two carriers 30*b* aligned with the platens 20*b* at the planarizing stations can each bias a substrate 12 against opposing outwardly facing portions of the polishing pad 40*b*. Devices such as the apparatus 10*b* shown in FIG. 3 are available from Aplex, Inc. of Sunnyvale, Calif. under the name AVERA™. Similar devices with a horizontally oriented polishing pad 40*b* and a single carrier 30*b* are available from Lam Research Corp. of Fremont, Calif.

During operation, the continuous polishing pad 40*b* moves at a relatively high speed around the rollers 25 while the carriers 30*b* press the substrates 12 against the polishing pad 40*b*. An abrasive slurry or other planarizing liquid having a suspension of abrasive particles is introduced to the surface of the polishing pad 40*b* which, in combination with the motion of the polishing pad 40*b* relative to the substrates 12, mechanically removes material from the substrates 12.

One drawback with the continuous polishing pad device shown in FIG. 3 is that the polishing pad 40*b* must move at a high speed to effectively planarize the substrates 12, which can present a safety hazard to personnel positioned nearby, for example, if the polishing pad 40*b* should break, loosen or otherwise malfunction during operation. Another drawback is that once a defect forms in the polishing pad 40*b*, it can affect each subsequent substrate 12. The combined polishing pad 40*b*/support band 41 may also wear more quickly than other polishing pads because both a planarizing surface 42*b* of the polishing pad 40*b* and a rear surface 44 of the support band 41 rub against relatively hard materials (e.g., the polishing pad 40*b* rubs against the substrate 12 and the support band 41 rubs against the platen 20*b*). Still another drawback is that the interface between the support band 41 and the platen 20*b* can be difficult to seal, due to the high speed of the support band 41, and can therefore be susceptible to abrasion by the abrasive slurry. Furthermore, the abrasive slurry itself is generally expensive because it contains a suspension of abrasive particles and therefore the apparatus 10*b* can be expensive to operate because the abrasive slurry runs off the polishing pad 40*b* and must be replenished.

SUMMARY OF THE INVENTION

The present invention is directed toward methods and apparatuses for planarizing microelectronic substrates. In one aspect of the invention, the apparatus can include a platen having a support surface oriented at an angle offset from horizontal, a non-continuous polishing pad adjacent to the support surface of the platen with a planarizing surface also offset from horizontal, and a carrier proximate to the planarizing surface for biasing the microelectronic substrate against the polishing pad. The polishing pad can be an elongated web-format type polishing pad extending from a supply roll to a take-up roll or, alternatively, the polishing pad can be a circular planform polishing pad for use with a corresponding circular platen. In either case, the platen can be oriented vertically or at other non-horizontal angles, for example, such angles that allow planarizing liquid and material removed from the substrate to flow off the polishing pad under the force of gravity.

In another aspect of the invention, two web-type format polishing pads, each having a non-horizontal orientation, can be arranged side-by-side. In one aspect of this embodiment, the polishing pads can be adjacent opposite sides of a single platen. In another aspect of this embodiment, the polishing pads can be adjacent separate platens and a single carrier assembly can bias two substrates against each polishing pad.

In still a further aspect of the invention, the elongated polishing pad can be pre-attached to both a supply roll and a take-up roll of a removable cartridge. The supply roll and take-up roll can be removably attached to the spindles of a planarizing machine as a unit. In one aspect of this embodiment, the supply roll can be coupled to the take-up roll with a frame, and in another aspect of this embodiment, the frame can be eliminated.

In a method in accordance with an aspect of the invention, a non-continuous polishing pad can be oriented at a non-horizontal angle during planarization. In another aspect of the invention, the microelectronic substrate can be one of two substrates biased against two opposing polishing pads with a single substrate carrier, or the two substrates can be biased against a single platen with two carriers. In a method in accordance with another aspect of the invention, the polishing pad can be attached to the planarizing machine after having been pre-attached to a supply roll and a take-up roll.

DETAILED DESCRIPTION OF THE INVENTION

The present invention is directed toward methods and apparatuses for planarizing microelectronic substrates and/or substrate assemblies. Many specific details of certain embodiments of the invention are set forth in the following description and in FIGS. 4–7 to provide a thorough understanding of such embodiments. One skilled in the art, however, will understand that the present invention may have additional embodiments, or that the invention may be practiced without several of the details described in the following description.

Figure 3:
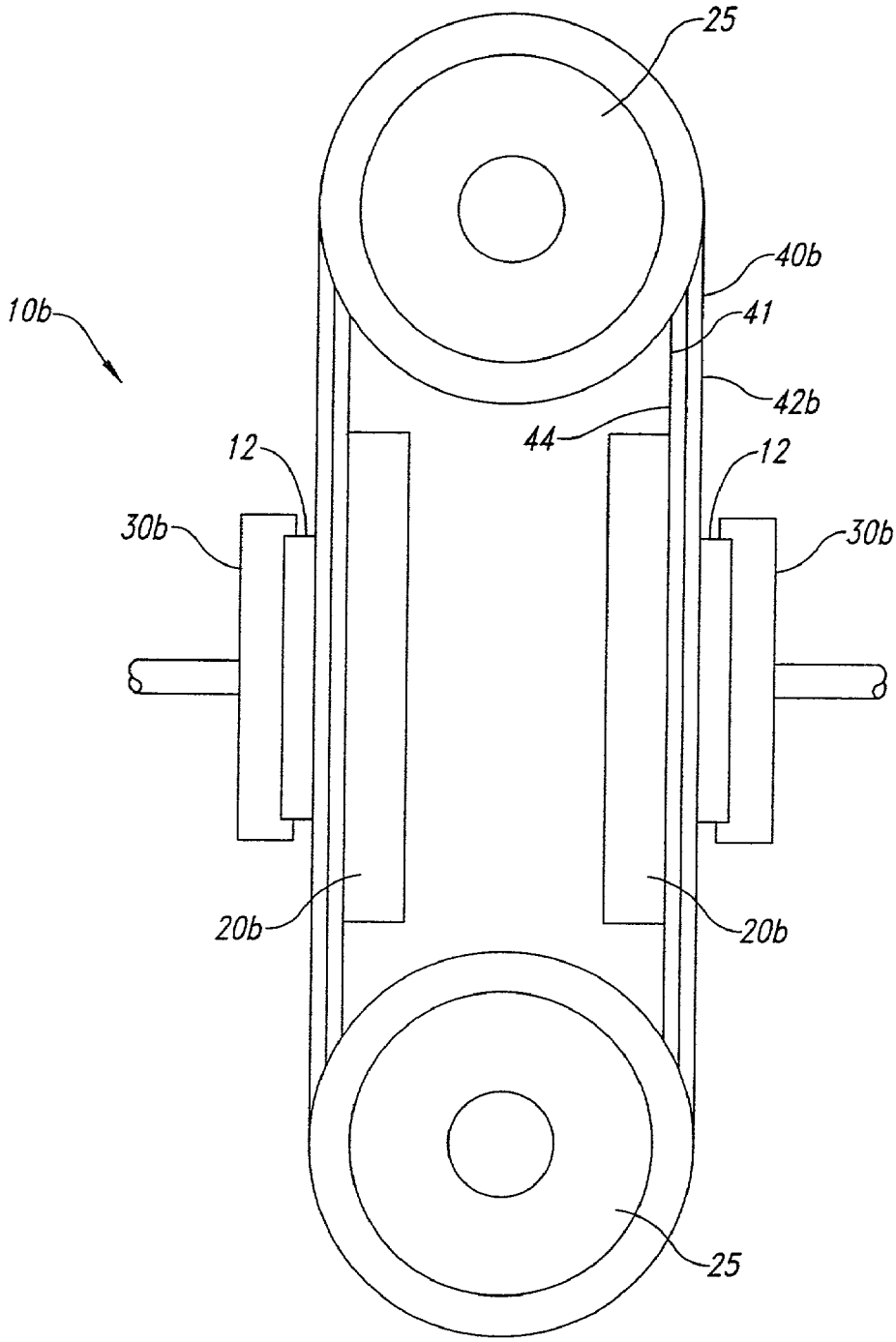
Fig. 3 (Prior Art)
FIG. 3 is a partially schematic side elevation view of a planarizing machine having a continuous polishing pad in accordance with the prior art.
Figure 4:
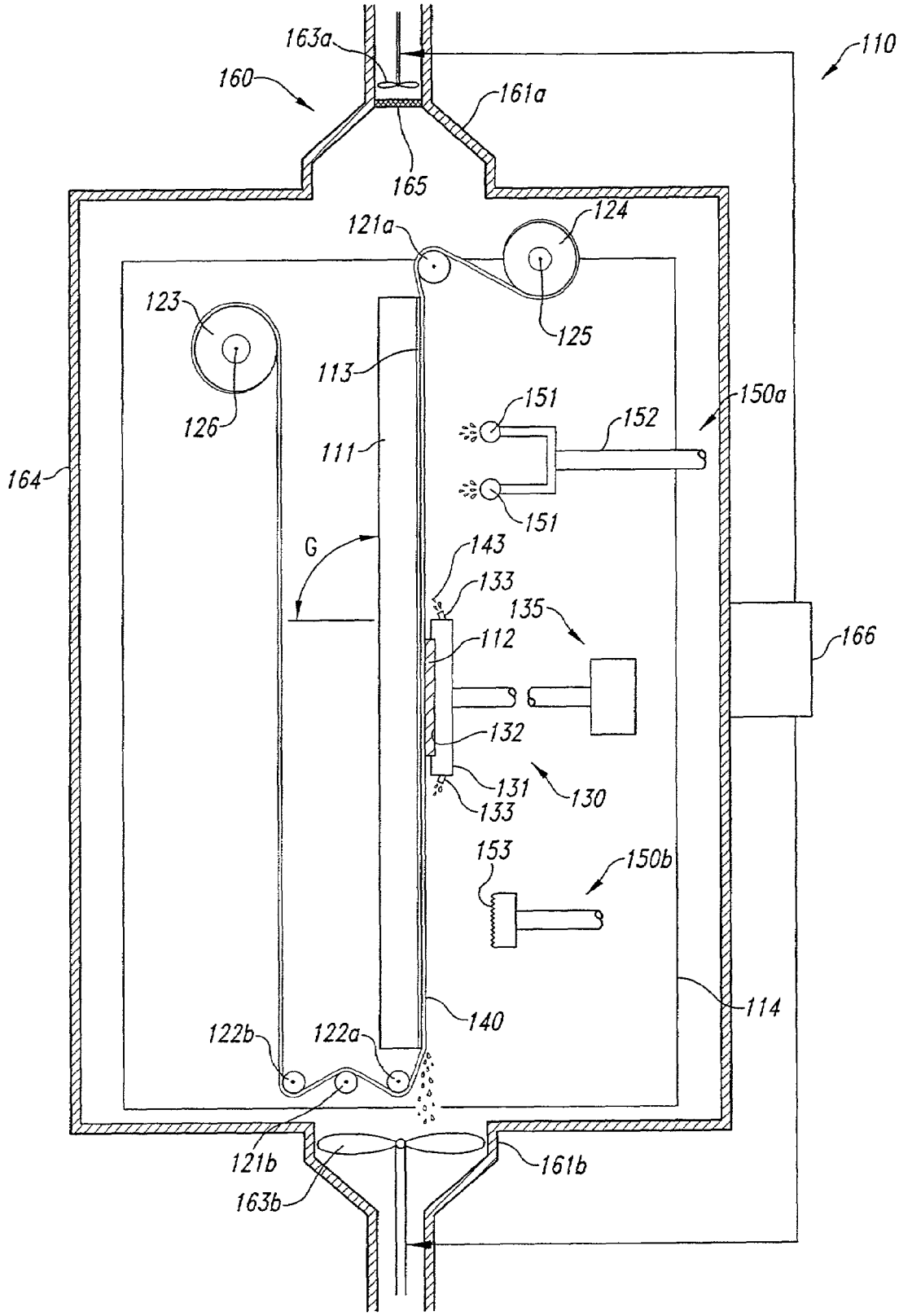
FIG. 4 is a partially schematic side elevation view of a planarizing machine in accordance with an embodiment of the invention.

FIG. 4 is a partially schematic side elevation view of an apparatus 110 having a frame 114 (shown schematically in FIG. 4) that supports an inclined polishing pad 140 in accordance with an embodiment of the invention. The polishing pad 140 can be an elongated web-format type polishing pad with or without fixed abrasive particles and formed from materials such as polyurethane. Unlike the polishing pad 40 of FIG. 3, the polishing pad 140 is not continuous. Instead, the polishing pad 140 can be connected to and extend between a supply roll 124 mounted on a supply roll spindle 125 and a take-up roll 123 mounted on a take-up roll spindle 126. The polishing pad 140 is guided and tensioned with guide rollers 122*a* and 122*b* and idler rollers 121*a* and 121*b* to position the polishing pad 140 over a table or platen 111 and a support surface 113, generally as was discussed above.

A carrier assembly 130 has a head 131 with an engaging surface 132 that engages a substrate or substrate assembly 112 and biases the substrate against the polishing pad 140 to remove material from the substrate 112, generally as was discussed above. The carrier assembly 130 can include a drive assembly 135 that moves the head 131 and the substrate 112 relative to the polishing pad 140. The head 131 can include planarizing liquid ports 133 that dispense a planarizing liquid 143 onto the planarizing surface of the polishing pad 140. The polishing pad 140 is moved incrementally from the supply roll 124 to the take-up roll 123, as was generally discussed above, and can be releasably held in place with releasable clamps or via vacuum system (not shown).

The platen 111 and the operative portion of the polishing pad 140 can be inclined relative to the horizontal by an angle G. For example, angle G can be approximately 90° relative to horizontal, as shown in FIG. 4. Alternatively, angle G can have other value less than 90°, so long as the planarizing liquid 143 can run off the polishing pad 140. For example, angle G can have any value less than 90° and greater than or equal to a minimum value of between approximately 0.6° and approximately 1.2° relative to horizontal.

One feature of the inclined platen 111 and polishing pad 140 is that the planarizing liquid 143 can entrain particulates that are removed from the substrate 112 and/or the polishing pad 140 and can run off the polishing pad 140 under the force of gravity. An advantage of this feature is that the particulates may be less likely to scratch or otherwise damage the substrate 112 because they are quickly removed from the non-continuous polishing pad 140. The non-continuous polishing pad 140 is moved incrementally over the inclined platen 111, either between planarizing operations of during planarization, unlike some conventional continuous polishing pads which are moved at a high rate of speed relative to the substrate 112. Accordingly, the polishing pad 140 can be less hazardous to personnel who might inadvertently contact the polishing pad 140 or who might be in the vicinity of the polishing pad if the polishing pad 140 malfunctions. Furthermore, because the motion of the polishing pad 140 can be incremental, it can be easier to seal the interface between the polishing pad 140 and the platen 111, reducing the likelihood that contaminants can become lodged at the interface. Such contaminants can increase the wear on the polishing pad 140 and reduce the uniformity with which the polishing pad 140 planarizes the substrate 112.

An additional feature of the inclined platen 111 and polishing pad 140 is that the apparatus 110 can have a smaller planform outline or "footprint." Accordingly, the apparatus 110 can take up less floor space than some conventional planarizing machines, allowing a greater number of machines to be positioned within a given floor area.

Still another feature of the apparatus 110 is that the polishing pad 140 can be a fixed abrasive polishing pad having abrasive elements fixedly dispersed at and beneath the planarizing surface (unlike the polishing pad shown in FIG. 3), and the planarizing liquid 143 can be relatively inexpensive, non-abrasive liquid (unlike the abrasive slurry discussed above with reference to FIG. 3) having a chemical composition selected to promote the removal of material from the substrate 112. An advantage of this feature is that the planarizing liquid can be liberally dispensed on the polishing pad 140 to wash away material removed from the substrate 112 and/or the polishing pad 140 without incurring a large increase in operating cost.

The apparatus 110 can also include a ventilation system 160 that smoothly removes exhaust gas and debris from the polishing pad 140. The ventilation system 160 can include a sealed or partially sealed enclosure 164 having two ports 161 (shown as a supply port 161*a* positioned above the platen 111 and an exit port 161*b* positioned below the platen 111). The supply port 161*a* can include a fan 163*a* (or another gas propulsion device, such as an ejector) that directs incoming ventilation air through a filter 165 and into the enclosure 164. The exit port 161*b* can include a fan 163*b* for drawing air and/or other gases downwardly over the platen 111 and the polishing pad 140 during operation. Alternatively, the supply port 161*a* and/or the exit port 161*b* can be coupled to a remote gas propulsion device.

A controller 166 (shown schematically in FIG. 4) can be operatively coupled to the fans 163*a*, 163*b* to control the flow rate and pressure of gas passing through the enclosure 164. For example, the controller 166 can control the pressure within the enclosure 164 to be less than or greater than atmospheric pressure and can include a limit feature to prevent the pressure from exceeding or falling below selected limits. In one embodiment where the apparatus 110 is surrounded by one or more zones (each of which may have a different pressure), the controller 166 can maintain the pressure within the enclosure 164 approximately equal to the lowest surrounding pressure to prevent a flow of gases or particulates into or out of the enclosure 164 from lowest pressure zone. The controller 166 can be a mechanical, electrical, hydraulic, digital or other type of device that adequately controls the pressure within the enclosure 164 and/or the flow of gas through the enclosure 164, and can be operatively coupled anywhere along the path of the flow.

One feature of the ventilation system 160 is that the gas moves from the supply port 161*a* to the exit port 161*b* generally parallel to the polishing pad 140 and the platen 111. Accordingly, the flow of gas can remain laminar as it passes over the polishing pad 140. This is unlike some conventional arrangements in which the ventilation gas is directed perpendicular to the polishing pad so that it forms eddies and other turbulent structures upon impinging on the polishing pad. An advantage of the laminar ventilation gas flow is that it can be less likely to stir up potential contaminants and can be easier to capture in the exit port 161*b* for removal.

The apparatus 110 can also include conditioning devices 150, shown as a spray device 150*a* and an end effector 150*b*. The spray device 150*a* can include one or more spray nozzles 151 coupled to a spray conduit 152 which is in turn coupled to a source of cleansing liquid (not shown). The spray nozzles 151 can direct a spray of cleansing liquid toward the polishing pad 140 to help remove deposits from the polishing pad 140 which might otherwise affect the quality of the planarized surface of the substrate 112. The end effector 150*b* can be coupled to an actuator (not shown) and can include an abrasive surface 153 that is selectively engaged with the polishing pad 140 to roughen the polishing pad 140 and/or remove deposits from the polishing pad 140.

Figure 5:
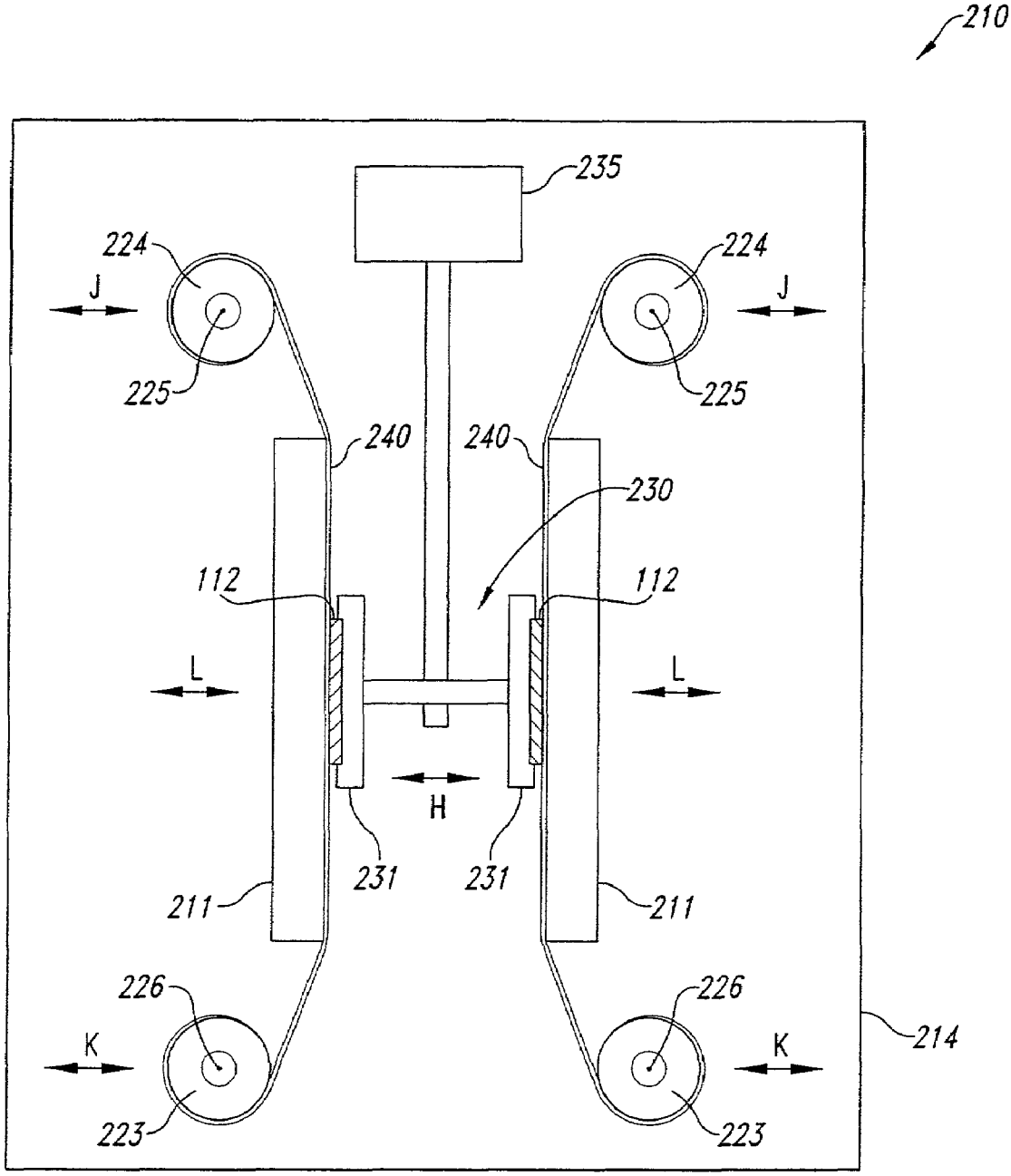
FIG. 5 is a partially schematic side elevation view of a planarizing machine having two polishing pads and a single carrier assembly that supports two substrates in accordance with another embodiment of the invention.

FIG. 5 is a partially schematic side elevation view of an apparatus 210 having two polishing pads 240 and a single carrier assembly 230 in accordance with another embodiment of the invention. Each of the polishing pads 240 is positioned against a corresponding platen 211 and extends from a corresponding supply roll 224 to a corresponding take-up roll 223. The supply rolls 224 and the take-up rolls 223 are supported by corresponding supply spindles 225 and take-up spindles 226, respectively, which, together with the platens 211, are supported by a frame 214. The supply spindles 225 are positioned above the take-up spindles 226. In one embodiment, the take-up spindles 226 are driven by a motor (not shown) to unroll the polishing pads 240 from the supply rolls 224 and roll the polishing pads 240 onto the take-up rolls 223. Alternatively, both the take-up spindles 226 and the supply spindles 225 can be driven.

The carrier assembly 230 includes two heads 231, each of which biases a corresponding substrate 112 against the corresponding polishing pad 240. The heads 231 can be coupled to a single actuator 235 that can simultaneously move both heads 231 in an orbital fashion relative to the polishing pads 240 to generate relative motion between the substrates 112 and the polishing pads 240. The actuator 235 can also independently control the motion of each head 231 normal to the corresponding polishing pad 240, as indicated by arrow H, to bias the corresponding substrate 112 against the corresponding polishing pad 240. Accordingly, the normal force between each substrate 112 and the corresponding polishing pad 240 (and therefore the rate at which material is removed from each substrate 112) can be controlled independently. In an alternate arrangement, two separate carrier assemblies 230 can move the substrates 112 completely independently of each other.

An advantage of the arrangement shown in FIG. 5 is that the apparatus 210 can planarize two substrates 112 simultaneously while taking up less space than two single-substrate planarizing machines. A further advantage is that the apparatus 210 may have fewer moving parts than two single-substrate planarizing machines. For example, the apparatus 210 can include a single carrier assembly 230 coupled to a single actuator 235, rather than two carrier assemblies and actuators. The lower part count can reduce both the initial cost and the maintenance costs of the apparatus 210.

In one aspect of the embodiment shown in FIG. 5, the apparatus 210 need not include guide rollers 121 (FIG. 4) or idler rollers 122 (FIG. 4). Instead, the supply spindle 225 and/or the take-up spindle 226 can move relative to the frame 214 and the platens 211, as shown by arrows J and K, respectively. Accordingly, the moving spindles 225 and 226 can keep the polishing pads 240 flush with and tensioned against the platens 211 while the diameter of the supply roll 224 decreases (as the polishing pad 140 unwinds from the supply roll 224) and the diameter of the take-up roll 223 increases (as the polishing pad 140 winds onto the take-up roll 223). An advantage of this arrangement is that, by reducing the number of rollers contacting the polishing pads 240, the wear and tear on the polishing pads can be reduced because the polishing pads 140 need not flex back and forth as often as they move between the supply rolls 224 and the take-up rolls 223. A further advantage is that the likelihood for transferring contaminants from the rollers to the polishing pads 240 can be eliminated by eliminating the rollers. Still another advantage is that the polishing pads 240 may be less likely to become misaligned relative to platens 211 as might occur, for example, if the rotational axes of the rollers are not precisely parallel with the edges of the platens 211.

In an alternate arrangement, the platens 211 can be moved relative to the spindles 225 and 226, either in addition to or in lieu of moving the spindles 225 and 226. For example, the platens 211 can move toward or away from the respective heads 231, as indicated by arrows L. The moving platens 211 can adjust the tension in the polishing pads 240, adjust the normal force between the polishing pads 240 and the corresponding substrates 112 and/or provide for flush contact between the polishing pads 240 and the corresponding platens 211. An advantage of the moving platens 211 is that they can reduce the number of rollers in contact with the polishing pad 240 and therefore reduce the wear on the polishing pad, as discussed above. Furthermore, by moving the platens 211 in conjunction with moving the spindles 225, 226, the forces between the substrates 112, the polishing pads 240, and the platens 211 can be more precisely adjusted.

Figure 6:
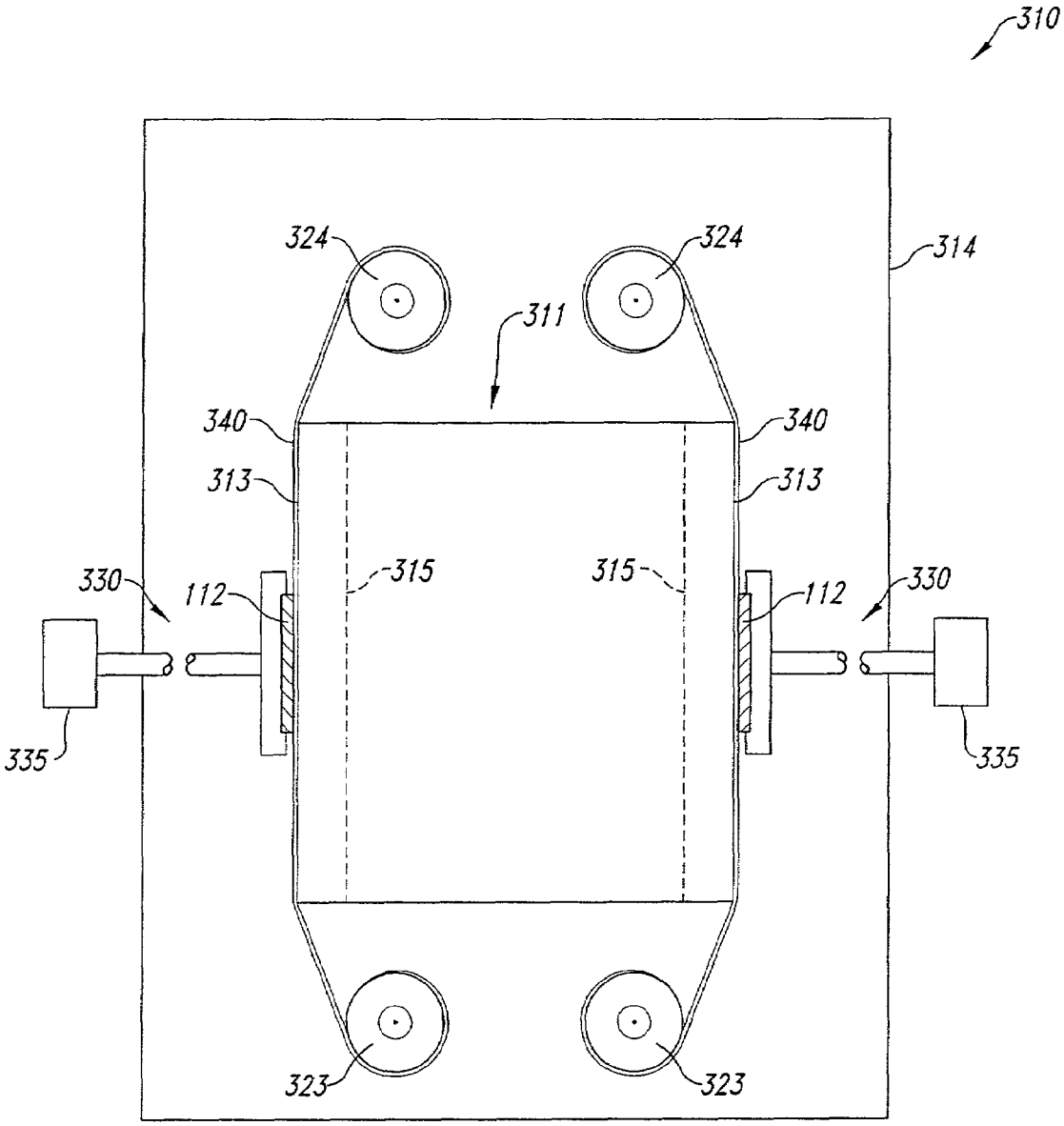
FIG. 6 is a partially schematic side elevation view of a planarizing machine having two polishing pads and a single platen unit in accordance with still another embodiment of the invention.

FIG. 6 is a partially schematic side elevation view of an apparatus 310 having two polishing pads 340 adjacent a single platen unit 311 in accordance with another embodiment of the invention. The platen unit 311 can include two opposite-facing support surfaces 313, each adjacent a corresponding polishing pad 340. Each polishing pad 340 can extend from a supply roll 324 to a take-up roll 323. The supply rolls 324, the take-up rolls 323 and the platen unit 311 are supported by a frame 314 and can be movable relative to each other in a manner generally similar to that described above with reference to FIG. 5. Two carrier assemblies 330, each coupled to a separate actuator 335, can bias a substrate 112 against the corresponding polishing pad 340. Alternatively, the two carrier assemblies 330 can be coupled to a single actuator 335 to move the two substrates 112 cooperatively.

One feature of the apparatus 310 is that a single platen unit 311 can be used to planarize two substrates 112. In an alternate arrangement, the single platen unit 311 can be divided along the dashed lines 315 shown in FIG. 6 to provide two separate platens. An advantage of both arrangements is that the apparatus 310 can planarize two substrates 112 while taking up less space than two single-substrate machines. An additional advantage, when compared with the apparatus 210 discussed above with reference to FIG. 5, is that the two carrier assemblies 330 can planarize the two substrates 112 independently of one another. Conversely, an advantage of the apparatus 210 is that the single carrier assembly 230 may be less expensive to manufacture and maintain.

Figure 7:
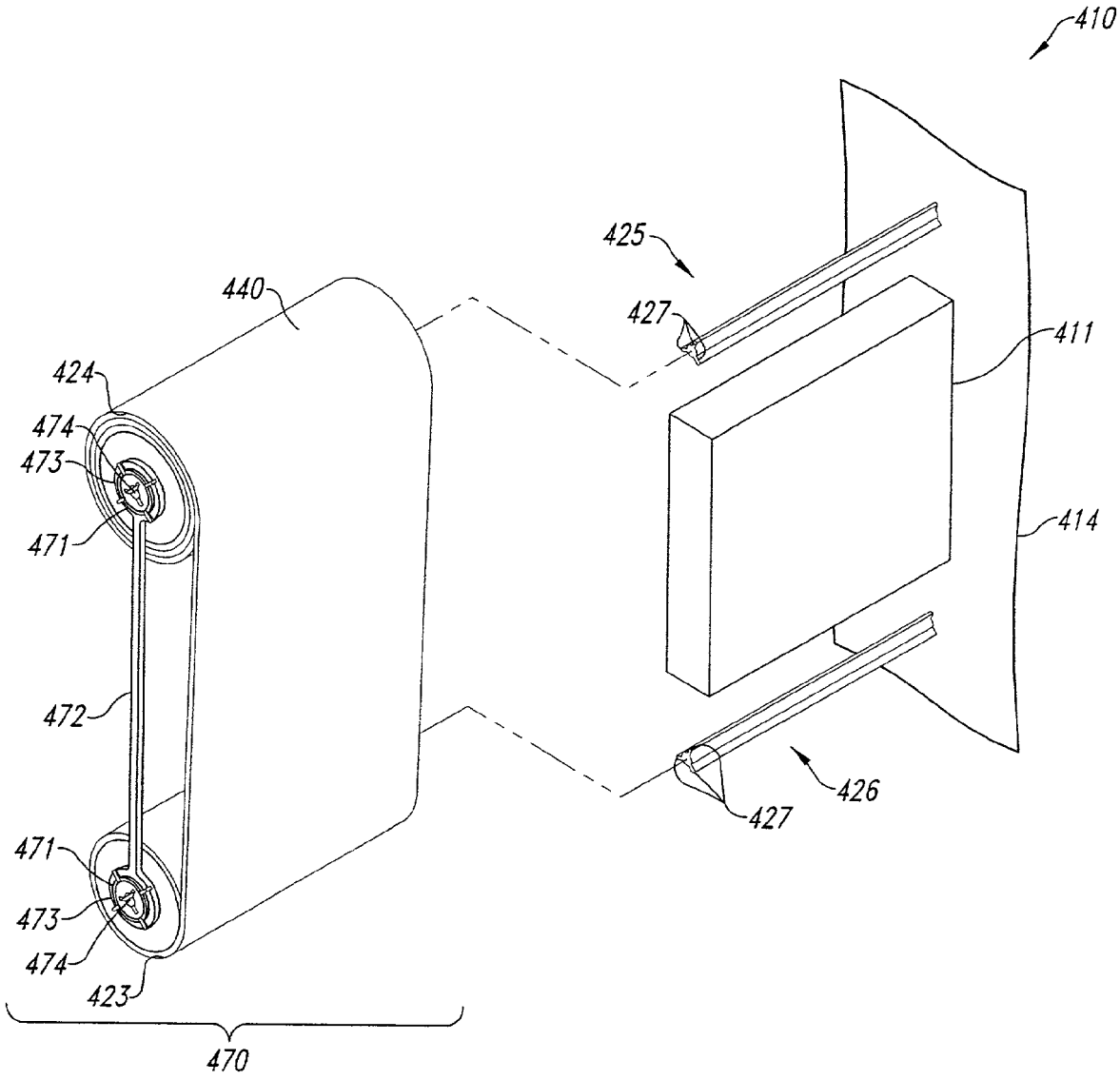
FIG. 7 is a side isometric view of a portion of a planarizing machine and a polishing pad cartridge in accordance with yet another embodiment of the invention.

FIG. 7 is a side isometric view of a portion of a planarizing machine 410 configured to receive a removable polishing pad cartridge 470 in accordance with another embodiment of the invention. The planarizing machine 410 includes a frame 414, a platen 411 attached to the frame 414, a supply roll spindle 425 positioned above the platen 411 and a take-up roll spindle 426 positioned below the platen 411. Each of the spindles 425, 426 is rotatably coupled to the frame 414 and can include a plurality of spaced apart splines 427 that extend along the length of the spindle.

The polishing pad cartridge 470 includes a web-format polishing pad 440, which is initially rolled up on a supply roll 424. One end of the polishing pad 440 is attached to a take-up roll 423 that is spaced apart from the supply roll 424 by the same distance that separates the supply roll spindle 425 from the take-up roll spindle 426. The supply roll 424 and the take-up roll 423 can each include an axle 471 that extends through the respective roll. Each axle 471 can have a spline aperture 474 that extends through the axle and is configured to slidably receive the splines 427 of the spindles 425 and 426. In one embodiment, a cartridge frame 472 couples the two axles 471 to maintain the separation distance between the supply roll 424 and the take-up roll 423. For example, the cartridge frame 472 can include an axle support portion 473 at each end that fits around a portion of the axle 471 that projects from the respective roll and allows the axle 471 to rotate relative to the cartridge frame 472. In one aspect of this embodiment, the frame 471 can be relatively lightweight and portable so as to be easily grasped during installation or removal.

In operation, the polishing pad cartridge 470 can be aligned with the spindles 425 and 426, such that the spline apertures 474 align with the corresponding splines 427. The cartridge 470 can then be installed on the spindles 425, 426 by moving the cartridge toward the spindles such that the spindles insert into the spline apertures 474. The cartridge 470 can be removed by sliding the axles 471 off the spindles 425, 426.

In one embodiment, the cartridge 470 can include a cartridge frame 472, as discussed above. In an alternate embodiment, the cartridge frame 472 can be eliminated. In either case, the supply roll 424 and the take-up roll 423 can be installed together on the corresponding spindles 425 and 426. Accordingly, the polishing pad 440 is pre-attached to both the supply roll 424 and the take-up roll 423, eliminating the need to partially unwind the polishing pad from the supply roll 424 then attach the polishing pad to the take-up roll 423. An advantage of this arrangement is that it can reduce the amount of time required to exchange one polishing pad 440 for another, increasing the efficiency of the exchange process. This feature is particularly beneficial where, as in the arrangement shown in FIG. 7, the apparatus 410 does not include guide rollers or idler rollers (FIG. 4) around which the polishing pad must be threaded.

Figure 1:
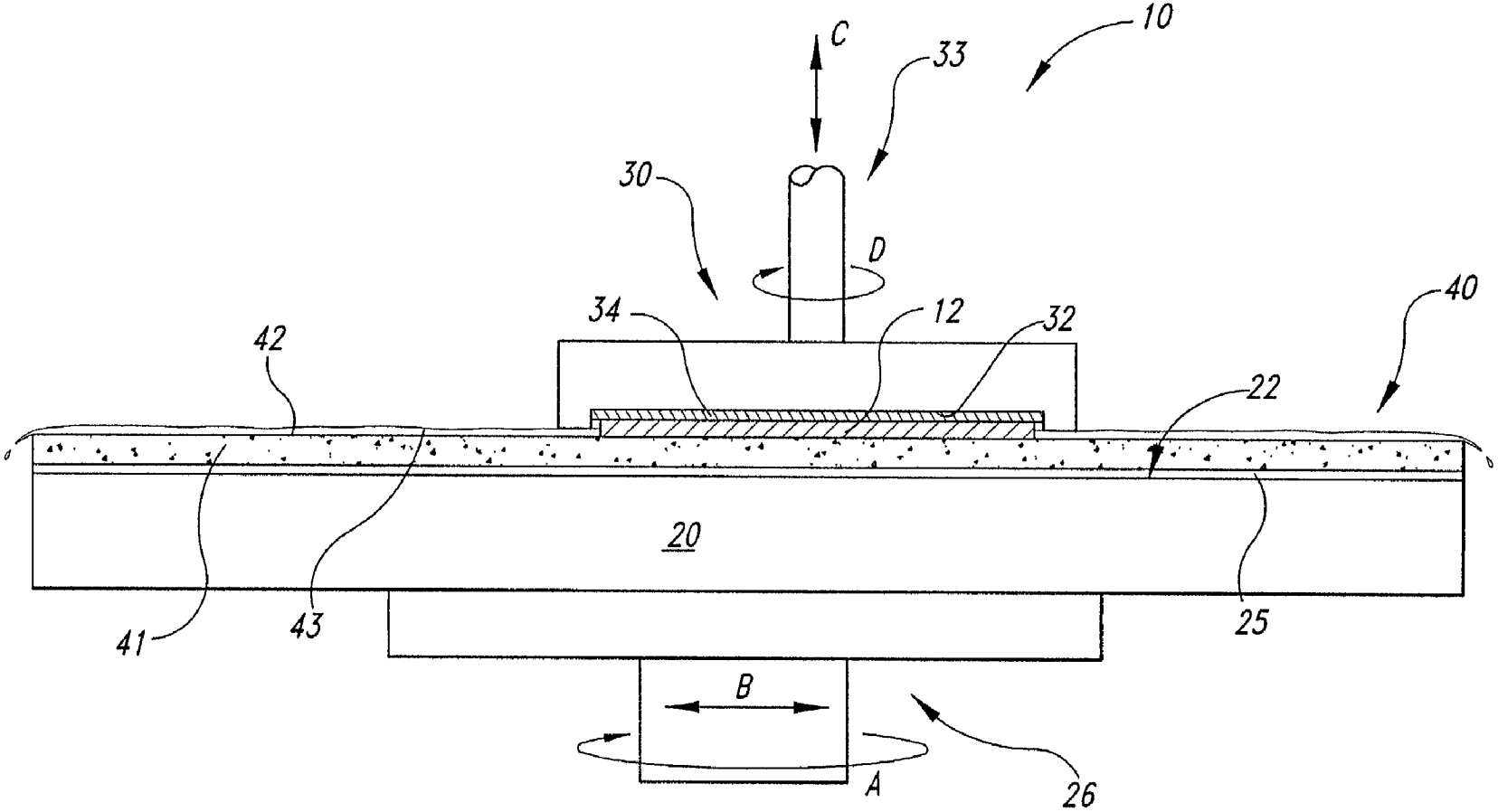
Fig. 1 (Prior Art)
FIG. 1 is a partially schematic side elevation view of a planarizing machine in accordance with the prior art.
Figure 2:
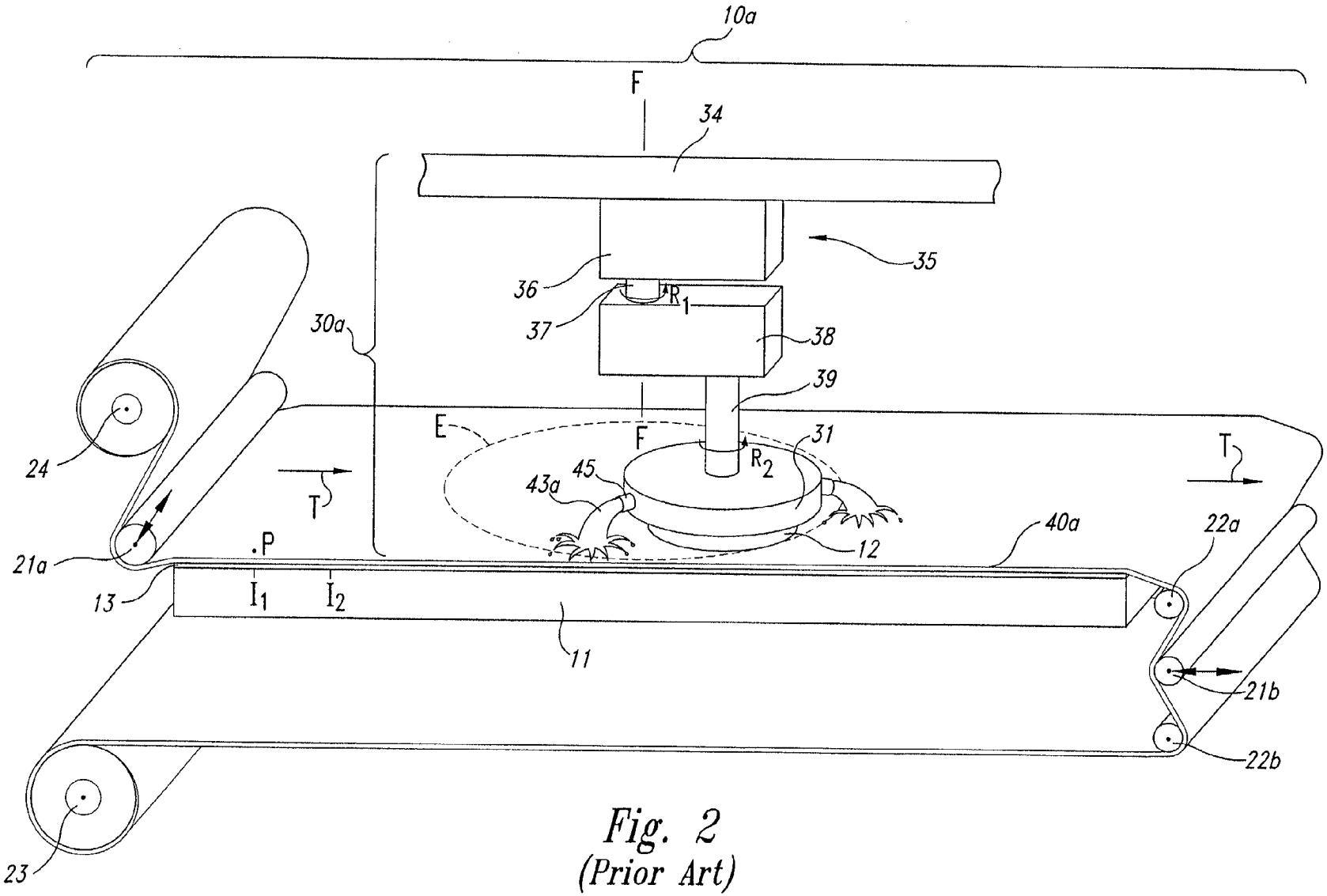
Fig. 2 (Prior Art)
FIG. 2 is a partially schematic isometric view of a web-format planarizing machine in accordance with the prior art.

From the foregoing it will be appreciated that, although specific embodiments of the invention have been described herein for purposes of illustration, various modifications may be made without deviating from the spirit and scope of the invention. For example, certain features shown in the context of one embodiment of the invention may be incorporated in other embodiments as well. For instance, the cartridge shown in FIG. 7 may be used in connection with the planarizing machines shown in FIGS. 5 and 6. The planarizing machines shown in FIGS. 5 and 6 may include features, such as the ventilation system and conditioning devices shown in FIG. 4. The planarizing machine can include a web-format polishing machine, such as shown in FIGS. 4–7, or the planarizing machine can include a non-horizontal, non-continuous polishing pad having a circular planform, such as shown in FIG. 1. Accordingly, the invention is not limited except as by the appended claims.

What is claimed is:

1. An apparatus for planarizing a microelectronic substrate, comprising:

a platen having a support surface oriented at an angle offset from horizontal during operation;

a non-continuous polishing pad adjacent to the support surface of the platen and having a planarizing surface offset from horizontal and generally parallel to the support surface of the platen during operation;

a substrate carrier at least proximate to the planarizing surface of the polishing pad, the carrier having at least one engaging surface for engaging the microelectronic substrate and biasing the microelectronic substrate against the polishing pad, at least one of the carrier and the polishing pad being movable relative to the other to remove material from the microelectronic substrate;

a frame;

a supply spindle coupled to the frame and positioned to receive the polishing pad;

a take-up spindle coupled to the frame and spaced apart from the supply spindle, the supply spindle being positioned above the take-up spindle, the take-up spindle being positioned to receive a used portion of the polishing pad, the platen being coupled to the frame and positioned proximate to the supply spindle and the take-up; and a ventilation supply port proximate to the supply spindle and a ventilation exit port proximate the take-up spindle for passing ventilation gas adjacent the polishing pad when the polishing pad is supported, wherein the polishing pad has a planarizing surface plane and the supply port directs the ventilation gas generally parallel to the planarizing surface plane downwardly toward the ventilation exit port.

2. The apparatus of claim 1 wherein the support surface of the platen and the planarizing surface of the polishing pad are approximately vertical during operation.

3. The apparatus of claim 1 wherein the platen and the polishing pad each have a generally circular planform shape.

4. An apparatus for planarizing a microelectronic substrate, comprising:

a frame;

a supply spindle coupled to the frame and positioned to receive a non-continuous elongated polishing pad;

a take-up spindle coupled to the frame and spaced apart from the supply spindle, the supply spindle being positioned above the take-up spindle, the take-up spindle being positioned to receive a used portion of the elongated polishing pad;

a platen positioned proximate to the supply spindle and the take-up spindle, the platen having a generally flat support surface for supporting a portion of the elongated polishing pad, the support surface being oriented at an angle offset from horizontal during operation; and a substrate carrier at least proximate to a planarizing surface of the polishing pad when the polishing pad is installed on the spindles, the carrier having at least one engaging surface for engaging the microelectronic substrate and biasing the microelectronic substrate against the polishing pad, at least one of the carrier and the polishing pad being movable relative to the other to remove material from the microelectronic substrate; and a ventilation supply port proximate to the supply spindle and a ventilation exit port proximate the take-up spindle for passing ventilation gas adjacent the polishing pad when the polishing pad is supported, wherein the polishing pad has a planarizing surface plane and the supply port directs the ventilation gas generally parallel to the planarizing surface plane downwardly toward the ventilation exit port.

5. The apparatus of claim 4 wherein the support surface of the platen is oriented approximately vertically during operation.

6. The apparatus of claim 4 wherein the support surface forms an angle of at least approximately 0.6 degrees relative to horizontal during operation.

7. The apparatus of claim 4 wherein the support surface forms an angle in the range of between approximately 0.6 degrees and approximately 1.2 degrees relative to horizontal during operation.

8. The apparatus of claim 4 wherein the take-up spindle is coupled to an actuator for rotating the take-up spindle relative to the frame.

9. The apparatus of claim 4, further comprising a pad conditioner positioned proximate to the polishing pad for conditioning a planarizing surface of the polishing pad.

10. The apparatus of claim 9 wherein the pad conditioner includes a plurality of orifices proximate to the polishing pad for directing a cleansing fluid toward the polishing pad.

11. The apparatus of claim 9 wherein the pad conditioner includes an end effector having a conditioning surface positioned to remove material from the polishing pad, the end effector being coupled to an actuator for moving the end effector relative to the polishing pad.

12. The apparatus of claim 4, further comprising the elongated polishing pad, wherein the elongated polishing pad is attached at one end to a supply roll on the supply spindle and is attached at an opposite end to a take-up roll on the take-up spindle, the elongated polishing pad extending directly from the supply roll to the platen without passing adjacent another roller.

13. An apparatus for planarizing a microelectronic substrate, comprising:

a platen having a support surface for supporting a planarizing medium;

a planarizing medium supported by the support surface of the platen, the planarizing medium having a planarizing surface opposite the support surface for engaging the microelectronic substrate, the planarizing surface of the planarizing medium being oriented at a non-zero angle relative to horizontal;

a carrier at least proximate to the planarizing surface of the planarizing medium, the carrier having at least one engaging surface for engaging the microelectronic substrate and biasing the microelectronic substrate against the planarizing medium, at least one of the carrier and the planarizing medium being movable relative to the other to remove material from the microelectronic substrate;

an at least partially gas-tight enclosure around the carrier and the planarizing medium, the enclosure having an entrance port for admitting ventilating gas to the enclosure and an exit port for removing the ventilating gas from the enclosure, at least one of the entrance port and the exit port being coupleable to a gas propulsion device for moving the ventilating gas relative to the enclosure;

a controller operatively coupled to a flow path of the ventilating gas to control at least one of a pressure within the enclosure and a flow rate of the ventilating gas through the enclosure; and a ventilation supply port proximate to the supply spindle and a ventilation exit port proximate the take-up spindle for passing ventilation gas adjacent the planarizing medium when the planarizing medium is supported, wherein the planarizing medium has a planarizing surface and the supply port directs the ventilation gas generally parallel to the planarizing surface downwardly toward the ventilation exit port.

14. The apparatus of claim 13 wherein the planarizing medium includes a polishing pad having abrasive particles fixedly dispersed therein.

15. The apparatus of claim 13 wherein the gas propulsion device includes a fan.

16. The apparatus of claim 13 wherein the controller is electrically coupled to the gas propulsion device.

* * * * *

UNITED STATES PATENT AND TRADEMARK OFFICE

CERTIFICATE OF CORRECTION

PATENT NO. : 6,997,789 B2
APPLICATION NO. : 09/929137
DATED : February 14, 2006
INVENTOR(S) : Scott E. Moore It is certified that error appears in the above-identified patent and that said Letters Patent is hereby corrected as shown below:

| Column, Line | Reads | Should Read |
|---|---|---|
| Column 2, Line 19 | "stationery during operation." | --stationary during operation.-- |
| Column 5, Line 63 | "or via vacuum system" | --or via a vacuum system-- |
| Column 6, Line 16 | "operations of" | --operations or-- |
| Column 7, Line 9 | "from lowest" | --from the lowest-- |
| Column 10, Line 17 | "features, such as" | --features such as-- |
| Column 10, Line 49 | "take-up; and" | --take-up spindle; and-- |

Signed and Sealed this

First Day of April, 2008

JON W. DUDAS
*Director of the United States Patent and Trademark Office*